US006668460B2

(12) United States Patent
Feng

(10) Patent No.: US 6,668,460 B2
(45) Date of Patent: Dec. 30, 2003

(54) CORROSION RESISTANT LOCK BLADE KNIFE

(76) Inventor: Jonathan Feng, 1928 Tyler Ave., Suite H, El Monte, CA (US) 91733

( * ) Notice: Subject to any disclaimer, the term of this patent is extended or adjusted under 35 U.S.C. 154(b) by 16 days.

(21) Appl. No.: 10/052,135

(22) Filed: Jan. 17, 2002

(65) Prior Publication Data

US 2003/0131478 A1 Jul. 17, 2003

(51) Int. Cl.[7] ..... B26B 1/04
(52) U.S. Cl. ..... 30/161; 30/155
(58) Field of Search ..... 30/160, 161, 155, 30/158

(56) References Cited

U.S. PATENT DOCUMENTS 4,703,560 A 11/1987 Booker
4,896,424 A 1/1990 Walker
5,068,003 A * 11/1991 Takahashi et al. ..... 148/421
5,153,995 A 10/1992 Opinel
5,363,554 A * 11/1994 Partridge et al. ..... 29/889.71
5,437,101 A 8/1995 Collins
5,461,786 A 10/1995 Miller
5,511,310 A * 4/1996 Sessions et al. ..... 30/161
5,546,662 A 8/1996 Seber et al.
5,692,304 A 12/1997 Campbell
5,794,346 A 8/1998 Seber et al.
5,826,340 A * 10/1998 Hull ..... 30/161
6,122,829 A 9/2000 McHenry
6,256,887 B1 7/2001 Osborne
6,293,020 B1 * 9/2001 Julien ..... 30/350

* cited by examiner

*Primary Examiner*—Hwei-Siu Payer
(74) *Attorney, Agent, or Firm*—Trojan Law Offices

(57) ABSTRACT

The present invention relates to a corrosion resistant lock blade knife with a blade made of titanium. The blade is mounted in the handle along with a locking arm made of a substance that is also corrosion resistant. During opening and closing the tang contact edge rubs against the locking arm head. At least one of these surfaces is composed of a corrosion-resistant non-metal or a corrosion-resistant soft metal substance to prevent the gripping and binding effects and excessive that would occur at the contact surface during opening and closing of the knife.

16 Claims, 2 Drawing Sheets

CORROSION RESISTANT LOCK BLADE KNIFE

FIELD OF INVENTION

The present invention relates to a corrosion resistant lock blade knife with a blade made of titanium or titanium alloy and a locking arm (locking lever) made from a corrosion resistant substance that can be used for diving or in any other circumstance where a corrosion resistant knife is required. The locking arm can also be made of titanium or titanium alloy, or any other strong corrosion resistant substance. The invention also has a non-titanium corrosion resistant surface between the locking arm head of the locking arm and the end tang of the blade to prevent the negative effects of titanium/titanium or titanium/other metal rubbing during opening and closing of the knife.

PRIOR ART

Lock blade knives are relatively common. From the pocketknife to the utility knife there are many different kinds of lock blade knives employing different mechanisms of action. It is prior technology to have a locking arm received into a notch on the blade tang. A spring biases against the locking arm to keep locking arm in place and maintain the locked state of the knife.

Heretofore, most lock blade knives were made of stainless steel to take advantage of stainless steel's generally excellent qualities. With minimal care, stainless steel is generally resistant to tarnish or rust when exposed to normal oxygen and humidity conditions. Stainless steel is easy to clean, and resiliently hard so that it can be honed into a finely sharpened blade. It is very strong and resilient under most circumstances. However, stainless steel is an iron alloy. Because of the iron content, stainless steel is magnetic and highly conductive. Also because of the iron content, the stainless steel is reactive to reduction chemical reactions and is still susceptible to corrosion and rust. It is due to these qualities that stainless steel is a poor material for constructing a diving knife because it is susceptible to the ravages of corrosion by the minerals and pollutants contained in fresh water and salt water.

The problem with iron-based metals is that the oxide formed by oxidation does not firmly adhere to the surface of the metal and flakes off easily causing "pitting". Extensive pitting eventually causes structural weakness and disintegration of the metal. Corrosion occurs in the presence of moisture. For example when iron is exposed to moist air, it reacts with oxygen to form rust.

The formation of rust can occur at some distance away from the actual pitting or erosion of iron. This is possible because of iron's conductive nature and the electrons produced via the initial oxidation of iron can be conducted through the metal and the iron ions can diffuse through the water layer to another point on the metal surface where oxygen is available. This process results in an electrochemical cell in which iron serves as the anode, oxygen gas as the cathode, and the aqueous solution of ions serving as a "salt bridge."

The involvement of water accounts for the fact that rusting occurs much more rapidly in moist conditions as compared to a dry environment such as a desert. Many other factors affect the rate of corrosion. For example the presence of salt greatly enhances the rusting of metals. This is due to the fact that the dissolved salt increases the conductivity of the aqueous solution formed at the surface of the metal and enhances the rate of electrochemical corrosion. This is one reason why iron and steel tend to corrode much more quickly when exposed to salt water or moist salty air near the sea and the ocean.

Knife makers have realized this problem and tried to prevent the initial compromise of the metal by applying a protective coating to stainless steel knives, etc. However, if the coating is scraped, the corrosion will have a chance to begin. As explained above, due to the conductive nature of the iron content in steel, once compromised, the integrity of the metal is never the same. Because of the unique uses for which knives are intended, they are inevitably scrapped and scarred during use and thereby compromised. Because of its susceptibility to corrosion, stainless steel is a poor material from which to make a diving knife.

Titanium is well known in the metal industry as being very hard and durable. It is an excellent material from which to construct knife blades because of its strength and tendency to retain a very sharp cutting edge. However, titanium metal also has a negative point. When titanium metal comes into contact with and rubs against titanium and other metals including stainless steel, it experiences a galling effect (titanium galling effect) whereby binding and gripping to the other metal. This not only creates a generally unsatisfactory user experience, but it also causes a premature wearing of the contact surface between the titanium contact face and the other metal's contact face.

Knife makers have sought to take advantage of the unique properties of titanium enabling it to be polished into a highly refined cutting edge in both fixed and lock blade knives. However, they only have made fixed blade knives where the blade was made completely of titanium or titanium alloy. Heretofore, knife makers have not been able to take full advantage of the resiliency and strength of titanium in a lock blade knife without suffering the negative effects of the titanium galling effect. Knife makers have created complex dual-metal blades where the majority of the blade is stainless steel but a separate section of the blade that contains the cutting edge joined along a seam and made of titanium or titanium alloy. This involves a highly complex and very expensive manufacturing process and remains undesirable in the field of lock blade knives because the remainder of the knife blade is still made of corrosion susceptible metal.

SUMMARY OF INVENTION

The present invention relates to a corrosion resistant lock blade knife with a blade made of titanium. The blade is mounted in the handle along with a locking arm made of a substance that is also corrosion resistant. During opening and closing the tang contact edge rubs against the locking arm head. At least one of these surfaces must be composed of a corrosion-resistant non-metal or a corrosion-resistant soft metal substance to prevent the gripping and binding effects that would occur at the contact surface during opening and closing of the knife. The locking arm is biased against the tang of the knife blade by a biasing means. The biasing means pushes against the locking arm, automatically forcing it into the tang notch when the blade is pivoted into its fully open position. This action locks the lock blade knife in the open position. Titanium and titanium alloys are selected for the knife blade because of titanium's unique properties, including its strength and resistance to corrosion. These same qualities of titanium also make it a good substance from which to make the locking arm.

The present invention is a corrosion resistant knife designed for, but not limited to, use in and around salt water.

Most lock blade knives are commonly made of stainless steel. With care, stainless steel knives are resistant for most normal uses. However, because of corrosion, these stainless-steel knives fair relatively poorly when exposed to the minerals of fresh water and harsh salt water. Furthermore, stainless steel is relatively heavy. If a common stainless steel lock blade knife is used during diving, it must be cleaned, rinsed, dried and then polished before storage or the stainless steel knife will rapidly show signs of corrosion and wear. If the blade is scraped during diving and corrosion has a chance to begin, the metal will forever be compromised and susceptible to further corrosion.

In order to avoid the negative effects of corrosion and rust associated with the wear of mineral and saltwater on stainless steel, it is best to make a knife out of a metal that is strong and resistant to corrosion. Metal alloys such as brass and copper-nickel are more resistant to the corrosion of salt water, but lack the strength, rigidity and resilience necessary to be refined into a fine cutting edge to make the metal alloy useful for knife blades. They also must be polished regularly to retain a pleasant appearance.

Titanium is the one metal with all the required properties, but has heretofore been unused in lock blade knives because of its inherent galling effect on other metals. Titanium has excellent resistance to corrosion, erosion, and is relatively lightweight, non-magnetic and very strong. Titanium is immune to corrosive attack by saltwater or marine atmospheres. It also exhibits exceptional resistance to a broad range of acids, alkalis, natural waters, corrosive gases, reducing atmospheres, and organic media. Mere traces of moisture and/or air normally assure the development of a stable protective oxide film that protects titanium. This titanium oxide ($TiO_2$) layer forms easily and readily, thereby preventing the corrosion of titanium.

Titanium is fully resistant to natural seawater regardless of chemistry variations and pollution effects. Twenty-year corrosion rates well below 0.003 mm/yr (0.01 mils/yr) have been measured on titanium exposed beneath sea, in marine atmospheres, and in splash or tidal zones. Abrasion and cavitation resistance is outstanding. Titanium develops a thin tenacious and highly protective surface oxide film. The surface of titanium will, if scratched or damaged, immediately re-heal and restore itself in the presence of air or even very small amounts of water. The corrosion resistance of titanium depends on a protective titanium oxide ($TiO_2$) surface oxide film. Titanium is also virtually non-magnetic. These unique molecular properties of titanium allow it to be superiorly resistant to the harsh environment of the ocean without requiring extensive cleaning immediately after usage.

Divers and other people can use this corrosion resistant lock blade knife in and around fresh and salt water without being concerned about corrosion. Often, divers will use knives for dislodging items on the ocean floor, or for cutting things while diving in the ocean or sea. The knife must be strong and resistant to breaking. The knife should also be lightweight because the diver will already be loaded with a heavy diving breathing apparatus and wetsuit. Any weight reductions, even to equipment, would prove a great benefit to divers. The titanium alloy in the knife allows for exceptional strength so that the knife will not break or deform during use. The titanium content also enables the knife to retain its superiorly sharp cutting edge. The lightweight feature of titanium will improve the overall use experience by the diver. The corrosion resistant features of titanium will enable the diver to experience the cost saving and time saving benefit of not having to meticulously clean the blade for fear of salt water corrosion even if the surface of the blade is compromised. The $TiO_2$ layer will immediately reform protecting the titanium knife blade from any corrosion.

This corrosion resistant knife blade is made of titanium or titanium alloy to take advantage of the unique corrosion resistant and strength properties associated with titanium. The locking arm mechanism must also be made of a corrosion resistant material. Titanium is an excellent material to take advantage of the same superior strength and corrosion resistant properties. The nature and mechanism of the lock blade knife requires that the end tang of the blade rub against locking arm head during opening and closing. The negative property of titanium is that when titanium surfaces rub up against other metal surfaces, including titanium, a galling effect occurs. The unique molecular properties of titanium create a binding effect that results in an unusually high amount of gripping and wear. The gripping also results in an uneven transport during opening and closing of the lock blade knife.

To avoid this unusually high amount of wear that leads to a shortened product life, a barrier is placed between the locking arm head contact surface and the knife blade end tang contact edge. A portion of the locking arm head can be replaced with an interlocking divot made of a non-titanium but similarly non-corrodible substance. This divot receptacle region still allows for the knife to take full advantage of the benefits that titanium offers, but avoids the drawbacks of titanium surface/metal surface rubbing. The divot should preferably be composed of a material that contains no titanium. The other requirements for the divot is that it must be strong and resistant to wear and also resistant to corrosion. Reinforced plastic materials such as Dupont's Delrin® acetal resin or materials such as Teflon® are excellent for use in the divot. Brass may also be used because of its corrosion resistant qualities and nature as a soft metal. If brass is used for the divot, wear will still occur but this will not be detrimental to the knife's usage experience. The divot may be a separately formed part or it may be injection molded. The benefits of replacing this area with such a corrosion resistant material are that the knife will be easier to open and close and have a longer in service usage life. The smooth opening and closing will also have the side effect of preventing undesirable accidental cuts by the sharp knife blade.

By having a strong titanium blade and a strong titanium locking arm, a further benefit of the knife will be its long service life for the user. A further benefit of titanium is that it retains blade sharpness. The ability of titanium to retain superior blade sharpness on the knife's cutting edge is demanded by users and has long been sought after by lock blade knife makers.

The handle parts may be cast or machined metal such as aluminum, or made of a suitable reinforced plastic material such as strong glass fiber-reinforced plastic material, or nylon fiber-reinforced plastic material. The handle can be formed of one piece or composed of multiple parts attached together. The handle should be relatively strong and also resistant to the corrosive qualities of water.

DETAILED DESCRIPTION OF THE PREFERRED EMBODIMENTS

Figures 1, 2:
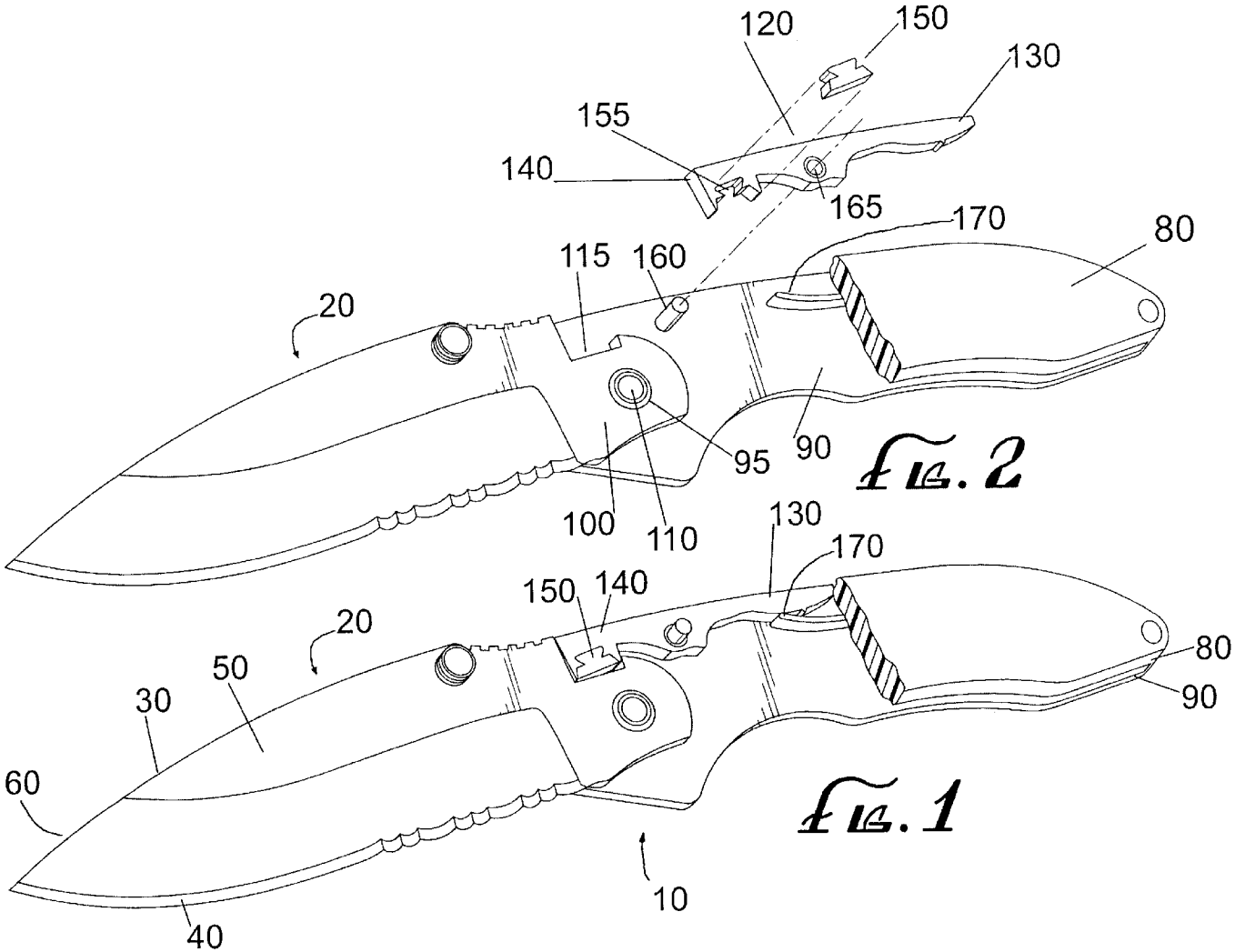
FIG. 1 is an elevational side view of a lock blade knife made in accordance with the present invention with side cover cutaway and with blade fully extended.
FIG. 2 is an exploded and perspective view of FIG. 1

FIG. 1 depicts the titanium lock blade knife 10 in an elevational side view. The blade 20 of the lock blade knife 10 is fully extended and locked into open position. FIG. 1 depicts the blade 20 with a first side 50 and a second side 60 a top edge 30 and a cutting edge 40 and end tang 100 with notch 115. Locking arm 120 is depicted in locked position with biasing means 170 pushing against locking arm tail 130. Locking arm head 140 is received in notch 115 thereby locking blade in open position. Both the blade 20 and locking arm 120 are composed of titanium or titanium alloy. This is to take advantage of the corrosion resistant properties of titanium and also take advantage of the metal's innate strength. Notch 115 is for receiving the locking arm head 140 when the knife blade 20 is extended in open position. Here the locking arm head 140 is seated in notch 115. The blade axle passage 95 is shown with blade axle 110 piercing the tang 100 of knife blade 20.

FIG. 2 depicts an exploded view of locking arm 120. This depiction shows the individual components of the locking arm 120. Locking arm axle 160 is shown extending from a first side plate 90. The locking arm axle continues through to a second side plate 80, only shown in cut away. The locking arm axle 160 is stabilized by this configuration. The locking arm 120 is shown with locking arm axle passage 165. Locking arm 120 pivots about locking arm axle 160 as it passes through locking arm axle passage 165. Locking arm head 140 is shown with vacant divot receptacle 155. The divot receptacle 155 may be cast in locking arm 120 or cut away after casting. The interlocking divot 150 is shown isolated from the locking arm head 140 but within context. Divot 150 is comprised of a non-titanium substance. This substance may be a corrosion-resistant reinforced plastic or other substance such as a corrosion-resistant soft metal.

Figures 3, 4:
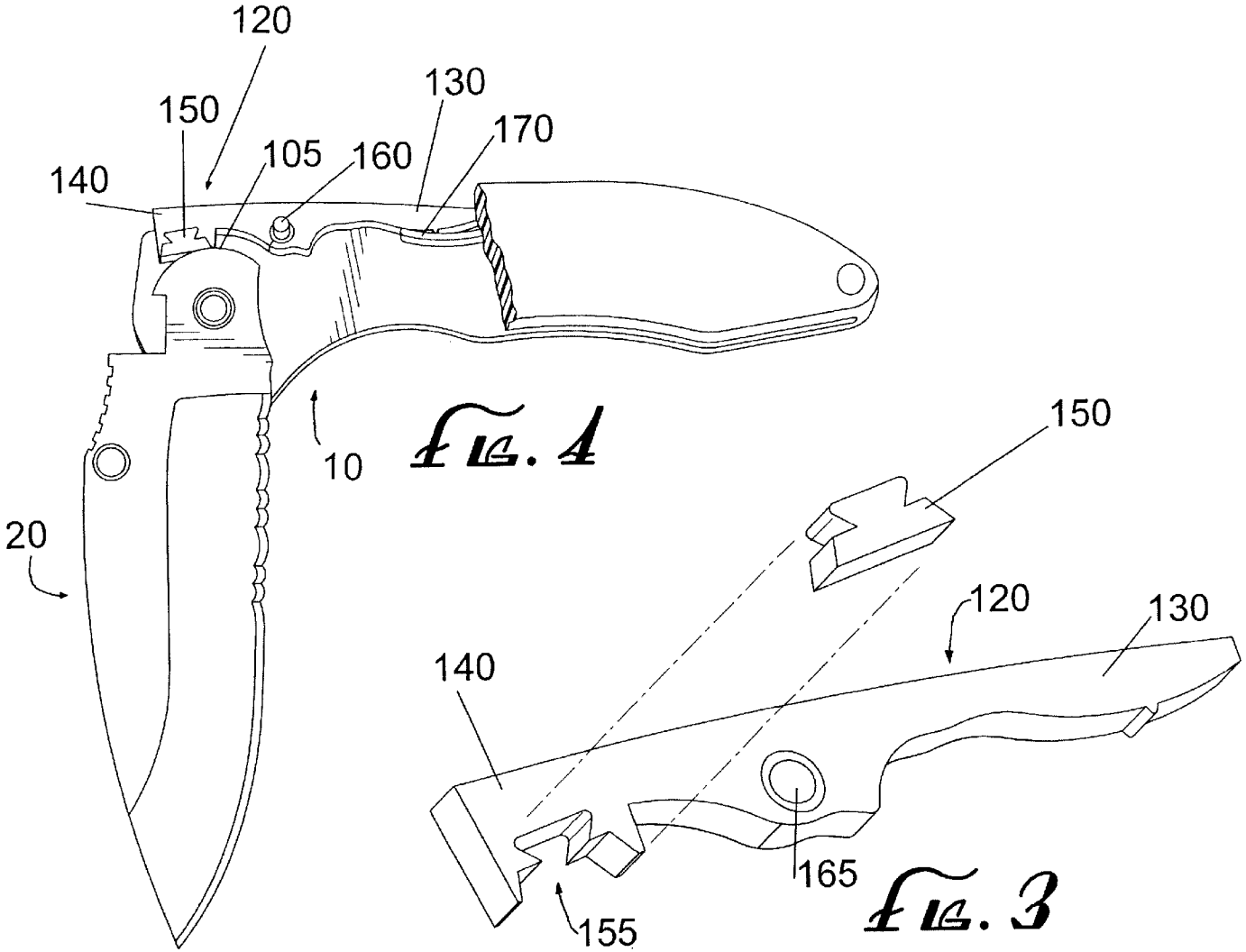
FIG. 3 is an exploded detail view of the locking arm.
FIG. 4 is an elevational side view with blade half closed to show locking arm tang interaction.

FIG. 3 depicts the locking arm 120 with divot 150 exploded from the locking arm head 140. Also shown is locking arm tail 130 and locking arm axle passage 165.

FIG. 4 depicts the lock blade knife 10 with blade 20 in transition from fully open position to closed position. This depiction shows the tang contact edge 105 in contact with divot 150 of locking arm 120. To unlock the blade 10 when fully extended into locked position, a user applies pressure against locking arm tail 130, this forces the spring 170 to give and the locking arm 120 to pivot about locking arm axle 160. Knife blade 20 is comprised of titanium or titanium alloy. Locking arm 120 is similarly comprised of titanium or titanium alloy. Once the knife blade 20 begins transition, the user will release the locking arm tail 130 allowing the spring to act against the locking arm tail 130, forcing the locking arm head 140 into contact with the titanium or titanium alloy tang contact edge 105. Without the divot implanted into the divot receptacle 155 of locking arm head 140, there would be the galling effect of direct titanium and metal contact. As depicted in FIG. 4., the divot 150 acts as shield allowing for smooth transport without the negative effect of titanium—titanium direct contact grasping and wear.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A corrosion resistant locking knife comprising:

a blade and a handle pivotally connected together;

said blade capable of being positioned in a closed position in which the blade is not available for use and is capable of being positioned in an open position where the blade is available for use;

a locking lever pivotally mounted on said handle and having a spring for biasing said lever against said blade in a first position to prevent movement of said blade, said lever capable of being pivoted to a second position out of interference with said blade;

said locking lever including a contact surface and said blade including a rear surface wherein said rear surface is capable of engaging said contact surface when said blade is moved between said open and said closed positions;

said blade containing titanium, and said contact surface comprised of a material that is resistant to binding against a titanium surface; and, whereby when said locking lever is moved from said first to said second position, then said titanium containing blade can be effectively open and closed without encountering excessive binding between said blade and said locking lever.

2. The locking knife of claim 1 wherein said locking, lever contains titanium.

3. The locking knife of claim 1 wherein said contact surface is comprised of a durable plastic material or corrosion resistant soft metal.

4. The locking knife of claim 2 wherein said contact surface contains Teflon®.

5. The locking knife of claim 2 wherein said contact surface is comprised of brass.

6. The locking knife of claim 2 wherein sand contact surface is comprised of Deirin®.

7. The locking knife of claim 1 wherein the locking lever contains titanium and has a cut out region for receiving said contact surface.

8. The locking knife of claim 7 wherein said contact surface is comprised of a durable plastic material or corrosion resistant soft metal.

9. The locking knife of claim 7 wherein said contact surface contains Teflon®.

10. The locking knife of claim 7 wherein said contact surface is comprised of brass.

11. The locking knife of claim 7 wherein said contact surface is comprised of Deirin®.

12. A corrosion resistant titanium lock blade knife comprising:

a blade having a cutting edge, a top edge, a first side, a second side and an end tang;

said blade comprised of metal selected from the group consisting titanium or titanium alloy;

a handle comprised of a corrosion resistant material;

a blade axle disposed within aligned apertures in said handle and passing through said end tang as to permit pivoting of said blade from a fully closed position whereby the cutting edge is recessed in said hand16xo a fully open position;

a locking arm, said locking arm having a locking arm head and a locking arm tail;

said locking arm comprised of metal selected from the group consisting titanium or titanium alloy;

said locking arm head having a divot receptacle region for receiving an interlocking divot;

a locking arm axle disposed within aligned apertures in said handle and passing through said locking arm as to permit pivoting about said locking arm axle;

said locking arm biased toward said end tang by a spring;

said tang having a notch, said notch to receive said locking arm head, when said blade is in said open position;

said interlocking divot composed of a corrosion resistant material containing no titanium, whereby a contact surface of said end tang rubs against the divot during said opening and said closing of said blade, preventing excessive binding between the end tang contact surface and said locking arm head.

13. The lock blade knife of claim 12 wherein said interlocking divot is comprised of a durable plastic material or corrosion resistant soft metal.

14. The lock blade knife of claim 12 wherein said wherein said interlocking divot contains Teflon®.

15. The lock blade knife of claim 12 wherein said interlocking divot is comprised of brass.

16. The lock blade knife of claim 12 wherein said interlocking divot is comprised of Delrin®.

* * * * *